US007435090B1

(12) United States Patent
Schriefer et al.

(10) Patent No.: US 7,435,090 B1
(45) Date of Patent: Oct. 14, 2008

(54) ROTATABLE VIDEO CONNECTOR FOR CABLES AND ADAPTERS

(76) Inventors: Tavis D Schriefer, 1846 Rosemeade Pkwy. Ste 144, Carrollton, TX (US) 75007; Edward A Stanfield, 1846 Rosemeade Pkwy. Ste 144, Plano, TX (US) 75007

( * ) Notice: Subject to any disclaimer, the term of this patent is extended or adjusted under 35 U.S.C. 154(b) by 0 days.

(21) Appl. No.: 11/696,046

(22) Filed: Apr. 3, 2007

Related U.S. Application Data

(60) Provisional application No. 60/789,907, filed on Apr. 6, 2006.

(51) Int. Cl.
*H01R 39/00* (2006.01)

(52) U.S. Cl. ..... 439/13; 439/11

(58) Field of Classification Search ..... 439/11, 439/8, 13, 21, 131, 136, 638
See application file for complete search history.

(56) References Cited

U.S. PATENT DOCUMENTS

| | | | |
|---|---|---|---|
| 4,061,381 | A | 12/1977 | Smal |
| 5,074,796 | A | 12/1991 | Carter |
| 5,542,850 | A | 8/1996 | Frantz |
| 5,681,171 | A | 10/1997 | Park |
| 5,882,226 | A | 3/1999 | Bell et al. |
| 6,394,813 | B1 | 5/2002 | Stout et al. |
| 6,488,510 | B2 | 12/2002 | Li |
| 6,595,782 | B1 | 7/2003 | Hsiao |
| 6,612,874 | B1 | 9/2003 | Stout et al. |
| 6,695,620 | B1 | 2/2004 | Huang |
| 6,713,678 | B2 | 3/2004 | Masuda et al. |
| 6,843,656 | B2 | 1/2005 | Hwang et al. |
| 6,881,069 | B2 | 4/2005 | Chen |
| 6,935,046 | B2 | 8/2005 | Tang et al. |
| 6,979,214 | B1 | 12/2005 | Liou |
| 6,986,665 | B2 | 1/2006 | Schauz et al. |
| 6,991,467 | B1 | 1/2006 | Cheng et al. |
| 7,172,428 | B2 | 2/2007 | Huang |
| 2004/0023520 | A1 | 2/2004 | Schriefer |
| 2005/0287827 | A1 | 12/2005 | Liao |
| 2006/0246742 | A1 | 11/2006 | Sun |

*Primary Examiner*—Michael C. Zarroli
(74) *Attorney, Agent, or Firm*—Quick Patents, Inc.; Kevin Prince

(57) ABSTRACT

An electrical connector is disclosed for conducting an electrical signal from a source, such as a video output device, to a destination, such as a video display device. The electrical connector includes a cable that has an outer sheath and contains at least one electrical conductor. An L-shaped plug is included that has a conduit therethrough for conveying each electrical conductor therethrough. A connector housing rotationally captures a proximal end of the plug and includes a jack electrically connected to at least one of the electrical conductors. The plug is preferably limited to rotation of approximately 270 degrees with respect to the connector housing, and includes a discernable detent every 90 degrees. As such, the cable may be rotated to any suitable position to facilitate the installation of the connector into the destination, but only through a limited arc.

16 Claims, 3 Drawing Sheets

ROTATABLE VIDEO CONNECTOR FOR CABLES AND ADAPTERS

CROSS-REFERENCE TO RELATED APPLICATIONS

This application claims the benefit of U.S. Provisional Patent Application 60/789,907, filed on Apr. 5, 2006.

STATEMENT REGARDING FEDERALLY SPONSORED RESEARCH AND DEVELOPMENT

Not Applicable.

FIELD OF THE INVENTION

This invention relates to electrical conductors, and more particularly to a novel rotatable electrical cable connector or adapter.

DISCUSSION OF RELATED ART

Electrical connectors for video cables are typically longitudinally aligned with a longitudinal axis of an electrical jack of the connector, such that the cable is typically projecting orthogonally away from a connector on, for example, the back of a computer or a video display monitor. In situations where there is limited space in an orthogonal direction, however, such as up against a wall or within a small space, such conventional cables may not be able to be used. Consequently, there is a need for cables having electrical connectors capable of projecting from different angles from the jack.

Several such devices can be found in the prior art. For example, a class of rotatable connectors can be found in the following US patents or patent applications:

| U.S. Pat. No. | Inventor | Date |
|---|---|---|
| 5,542,850 | Frantz | Aug. 6, 1996 |
| 5,681,171 | Park | Oct. 28, 1997 |
| 6,695,620 | Huang | Feb. 24, 2004 |
| 6,991,467 | Cheng et al. | Jan. 31, 2006 |
| 2006/0246742 | Sun | Nov. 2, 2006 |

All such prior art devices rotate around a horizontal axis that is parallel to a front side of a connector, which gives such connectors an effective range of 180 degrees. However, in the case where a wall or other obstruction is physically close to the connector to which such a device is to be connected, this range is severely limited to either substantially 90 degrees up or down with respect to the connector, and those two directions might also be blocked by obstructions such as tables, shelves, or the like. Thus, these types of connectors are not suitable for use many situations and installations.

A more universal solutions is one wherein the cable entering the connector can rotate around a longitudinal axis of the connector. Examples of such connectors are taught in the following US patents:

| U.S. Pat. No. | Inventor | Date |
|---|---|---|
| 4,061,381 | Sinai | Dec. 6, 1977 |
| 5,074,796 | Carter | Dec. 24, 1991 |
| 5,882,226 | Bell et al. | Mar. 16, 1999 |

-continued

| U.S. Pat. No. | Inventor | Date |
|---|---|---|
| 6,595,782 | Hsiao | Jul. 22, 2003 |
| 6,881,069 | Chen | Apr. 19, 2005 |
| 6,986,665 | Schauz et al. | Jan. 17, 2006 |

While such connectors are rotatable about a 360 degree angle with respect to the longitudinal axis of the connector, giving them considerable versatility in use, drawbacks exist with each. For example, such connectors typically use a spring-biased contact that slides against another circular contact so as to allow for rotation of the cable without twisting the conductors therein. Such rotating contacts can often produce electrical interference, particularly when the contacts are worn and old, and consume considerable space. None of these types of connectors have space for the up to 36 conductors founds in some video signal lines, for example.

Therefore, there is a need for an inexpensive electrical connector that can rotate freely around an arch of at least 270 degrees with respect to the longitudinal axis of its connector jack so as to orient the cable in a place having sufficient clearance. Such a needed device would be able to accommodate a relatively large number of electrical signal conductors, and would be intuitive to use. Further, such a connector would have a compact design allowing it to fit between and around other connector cables that may be in close proximity. The present invention accomplishes these objectives.

SUMMARY OF THE INVENTION

The present device is an electrical connector for conducting an electrical signal from a source, such as a video output device, to a destination, such as a video display device. The electrical connector includes a cable that has an outer sheath and contains at least one electrical conductor. The electrical connector further includes a substantially L-shaped plug that has a conduit therethrough for conveying the at least one electrical conductor of the cable therethrough. A distal end of the plug is adapted to receive a proximal end of the cable therein. A proximal end of the plug comprises an annular sleeve fixed to forward side of the distal end of the plug, and further includes a retaining ring fixed to the sleeve. The retaining ring has a larger diameter than that of the sleeve, such that a rotational channel is defined thereby.

The electrical connector further includes a connector housing, a distal end of which includes a plug retaining means adapted to rotationally capture the rotational channel of the plug. A proximal end of the housing includes a jack electrically connected to at least one of the at least one electrical conductors. Preferably, the connector housing further includes at least one connector screw for mechanically fixing the connector to the destination, such as to a video display connector, for example.

Preferably, the retaining ring of the plug further includes a stop channel formed along a peripheral edge thereof. The stop channel has two ends. Additionally, the connector housing includes a stop pin projecting into the stop channel, such that at each end of the stop channel the stop pin limits the rotation of the plug within the housing and thereby limits the amount of twisting that is experienced by the cable. The stop channel is preferably formed along generally a 270 degree arc of the retaining ring, such that the plug is limited to rotation of approximately 270 degrees with respect to the connector housing.

The retaining ring of the plug preferably further includes at least one detent depression, and the connector housing includes two detent prongs. Each detent prong is mechanically urged with a spring against the retaining ring along a rotational path of the at least one detent depression as the plug rotates within the housing. As such, when each detent depression becomes aligned with one of the at least one detent prongs, the detent prong is urged into the detent depression to cause a discernable detent, such as a tactile or audible indication, along the rotational path of the plug within the housing.

In use, the electrical signal may be conducted through the cable, plug, housing, and jack, the cable and plug being rotationally captured by the housing. As such, the cable may be rotated to any suitable position to facilitate the installation of the connector into the destination, but only through a limited arc.

The present device is an inexpensive electrical connector that can rotate freely around an arch of at least 270 degrees with respect to the longitudinal axis of its connector jack, thereby allowing the user to orient the cable where there is sufficient clearance. The present invention is able to accommodate a relatively large number of electrical signal conductors, such as is required with video signal connectors, and is intuitive to use. The present connector has a compact design allowing it to fit between and around other connector cables that may be in close proximity. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
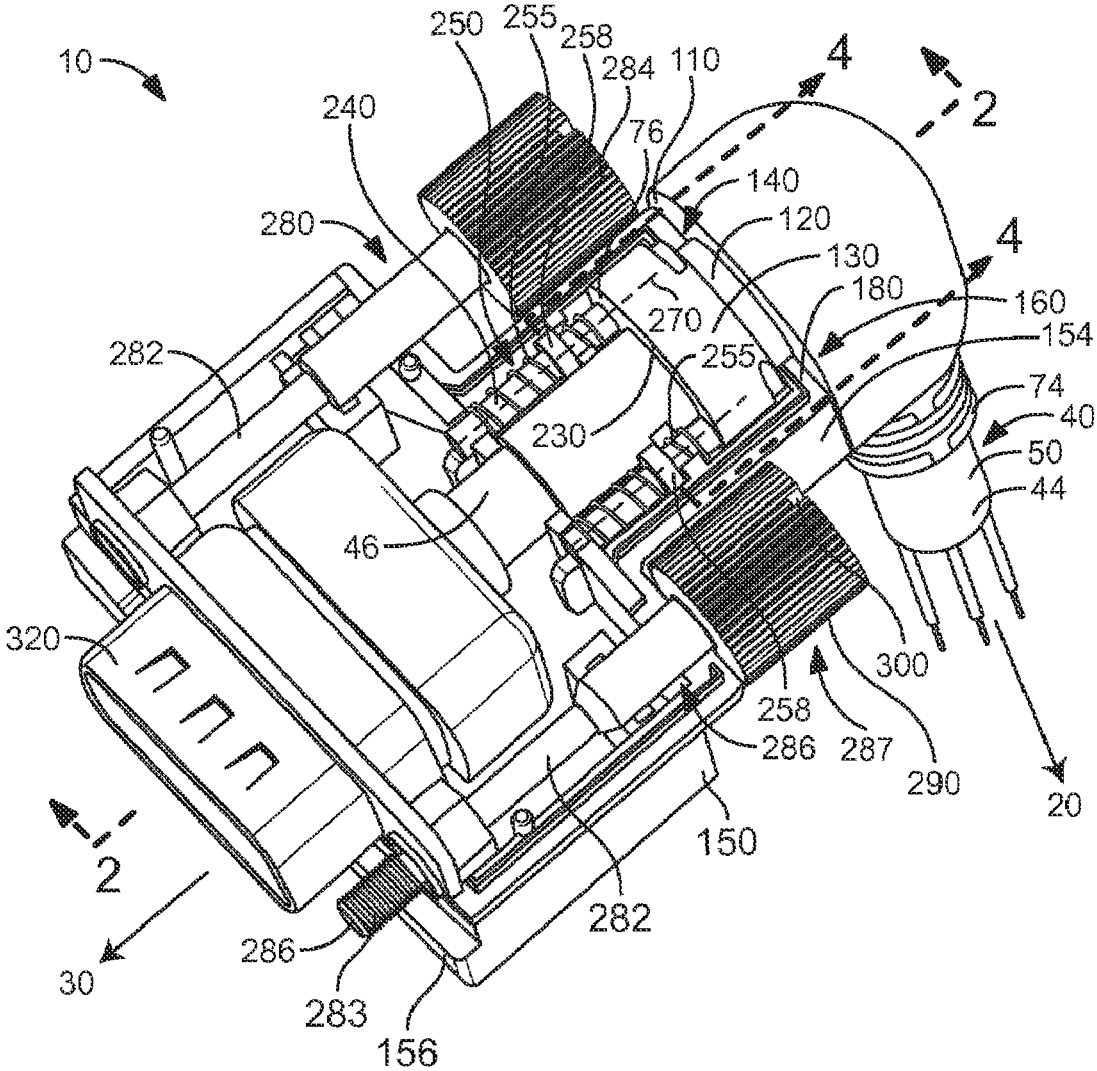
FIG. 1 is a cut-away perspective view of the invention.

The present invention is an electrical connector 10 for conducting an electrical signal from a source 20 to a destination 30. The source 20 may be a video output device (not shown), for example, and the destination 30 may be a video display device (not shown).

The electrical connector 10 includes a cable 40 that has an outer electrically insulating sheath 50 and contains at least one insulated electrical conductor 60. The cable 40 has a distal end 44 and a proximal end 46. The cable 40 may include as many as 36 electrical conductors 60 when, for example, the electrical signal is a video signal. However, other numbers of conductors 60 may be included within the cable 40 for other types of signals, as is known in the art.

Figure 2:
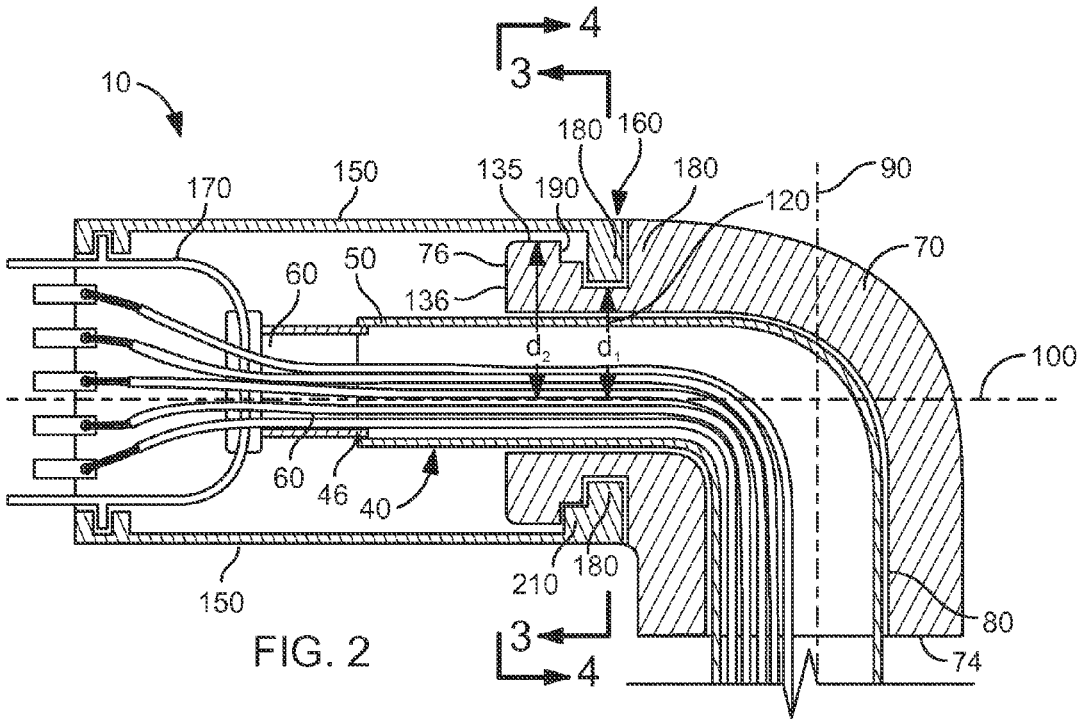
FIG. 2 is a cross-sectional view of the invention, taken generally along lines 2-2 of FIG. 1.
Figure 3:
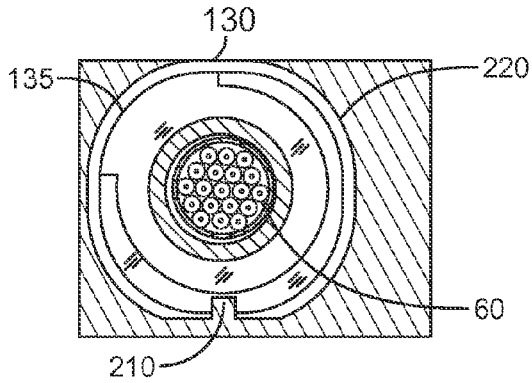
FIG. 3 is a cross-sectional view of the invention, taken generally along lines 3-3 of FIG. 2.

The electrical connector 10 further includes a substantially L-shaped plug 70 that has a conduit 80 therethrough for conveying the at least one electrical conductor 60 of the cable 40 therethrough. The L-shaped plug 70 further includes a distal end 74 and a proximal end 76 (FIG. 2), each of which have mutually perpendicular longitudinal axes 90,100 respectively. The distal end 74 is adapted to receive the proximal end 46 of the cable 40 therein, and includes a substantially flat retaining forward side 110. The proximal end 76 comprises an annular sleeve 120 fixed to the forward side 110 of the distal end 74 and further includes a retaining ring 130 fixed to the sleeve 120 (FIG. 3). The retaining ring has a larger diameter $d_1$ than the diameter $d_2$ of the sleeve 120 (FIG. 2). As such, a rotational channel 140 is defined by the sleeve 120, ring 130, and the forward side 110 of the distal end 74 of the L-shaped plug 70.

The electrical connector further includes a connector housing 150 (FIGS. 1 and 2) which comprises a distal end 154 and a proximal end 156. The distal end 154 includes a plug retaining means 160 adapted to rotationally capture the rotational channel 140 of the plug 70. The proximal end 156 includes a jack 170 electrically connected to at least one of the at least one electrical conductors 60.

Figure 5:
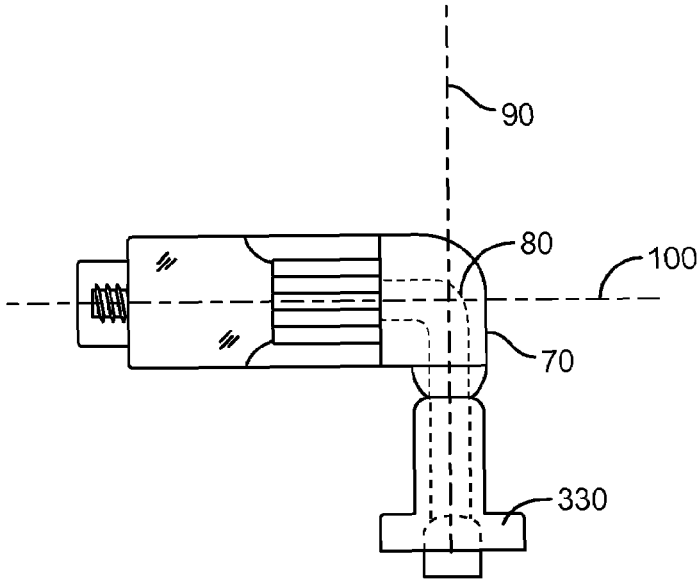
FIG. 5 is a left-side elevational view of an alternate embodiment of the invention.
Figure 6A:
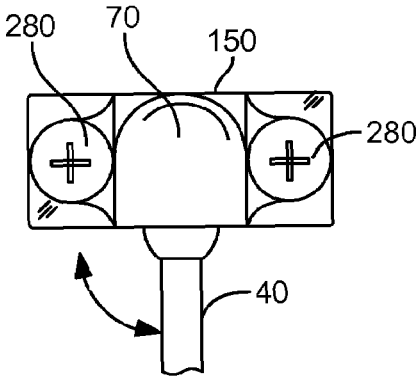
FIG. 6A is a rear elevational view of the invention, illustrating a cable at a 0 degree position with respect to a connector housing.
Figure 6B:
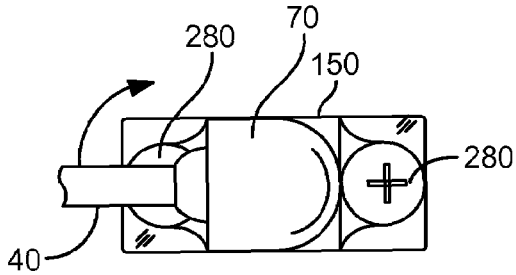
FIG. 6B is a rear elevational view of the invention, illustrating the cable at a 90 degree position with respect to the connector housing.
Figure 6C:
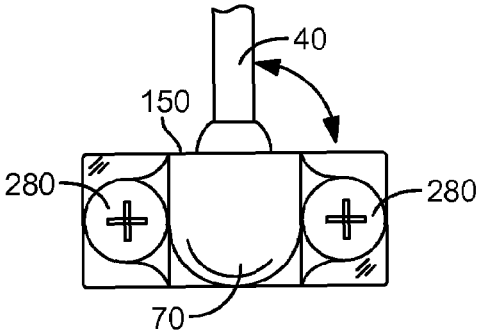
FIG. 6C is a rear elevational view of the invention, illustrating the cable at a 180 degree position with respect to the connector housing.
Figure 6D:
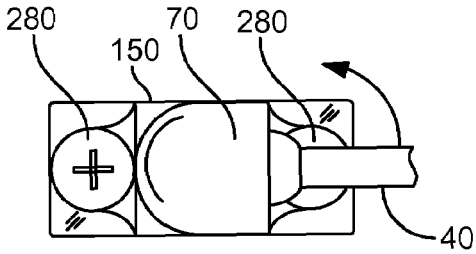
FIG. 6D is a rear elevational view of the invention, illustrating the cable at a 270 degree position with respect to the connector housing.

The jack 170 may be a female video jack (not shown), a male video jack 320, an interface jack (not shown), or the like. Further, the distal end 44 of the cable 40 may terminate in a second jack 330 (FIG. 5). In an alternate embodiment of the invention, the distal end 74 of the plug 70 terminates in the second jack 330, the cable 40 being completely contained within the second jack 330, the plug 70, and the connector housing 150, such that the electrical connector 10 takes the form of an electrical adapter (FIG. 5).

Preferably, the retaining ring 130 of the plug 70 further includes a stop channel 190 formed along a peripheral edge 135 thereof. The stop channel 190 has two ends 195. Additionally, the connector housing 150 includes a stop pin 210 projecting into the stop channel 190, such that at each end 195 of the stop channel 190 the stop pin 210 limits the rotation of the plug 70 within the housing 150 (FIG. 3) and thereby limits the amount of twisting that is experienced by the cable 40. The stop channel 190 is preferably formed along generally a 270 degree arc 220 of the retaining ring 130, such that the plug 70 is limited to rotation of approximately 270 degrees with respect to the connector housing 150.

Figure 4:
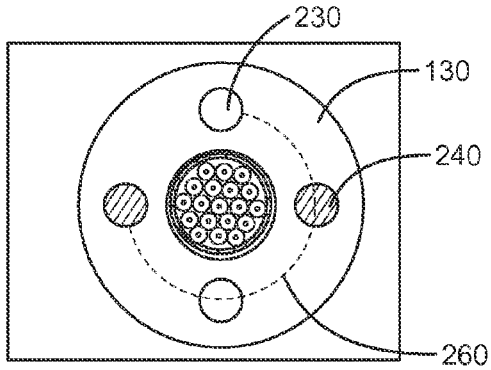
FIG. 4 is a cross-sectional view of the invention, taken generally along lines 4-4 of FIG. 1.

The retaining ring 130 of the plug 70 preferably further includes at least one detent depression 230 (FIGS. 1 and 4). In such an embodiment, the connector housing 150 includes at least one detent prong 240, and preferably two detent prongs 240, that are each mechanically urged with a spring means 250 against the retaining ring 130 along a rotational path 260 of the at least one detent depression 230 as the plug 70 rotates within the housing 150. As such, when each detent depression 230 becomes aligned with one of the at least one detent prongs 240, the detent prong 240 is urged into the detent depression 230 to cause a discernable detent, such as a tactile or audible indication, along the rotational path 260 of the plug 70 within the housing 150. Preferably each detent depression 230 is formed within a proximal side 136 of the retaining ring 130 (FIG. 2), and each spring means 250 is a coil spring 255 fixed between the connector housing 150 and a spring ring 258 formed in each detent prong 240 (FIG. 1). Each detent prong 240 advantageously has a longitudinal axis 270 that is substantially parallel to the longitudinal axis 100 of the proximal end 76 of the plug 70. As illustrated in FIGS. 4 and 6A-6D, the preferred embodiment of the invention includes exactly four detent depressions 230 that are substantially 90 degrees apart with respect to the longitudinal axis 100. As such, the at least one conductor 60 and the cable 40 are limited to 270 degrees of rotation between the plug and the jack 170.

Preferably, the plug retaining means 160 of the connector housing 150 is a collar 180 formed in the distal end 154 of the connector housing 150, the collar 180 projecting into the rotational channel 140 of the plug 70 (FIG. 2). Moreover, the connector 150 further includes at least one connector screw 280, each of which traverse the connector housing 150 from the distal end 154 to the proximal end 156. Each connector screw 280 is rotationally captured within the housing 150 and includes a shaft 282 having a thread 283 at least partially therealong proximate a proximal end 286 thereof. A rotation facilitation means 287 is included at a distal end 284 of each connector screw 280, such as a manual actuator 290, a Philips or regular screw head 300, or the like. As such, each connector screw 280 may be mechanically fixed to the destination 30, such as video display connector (not shown), for example.

In use, the electrical signal may be conducted through the cable 40, plug 70, housing 150, and jack 170, the cable 40 and plug 70 being rotationally captured by the housing 150. As such, the cable 40 may be rotated to any suitable position to facilitate the installation of the plug 170 into the destination 30, but only through a limited arch 220.

While a particular form of the invention has been illustrated and described, it will be apparent that various modifications can be made without departing from the spirit and scope of the invention. For example, the exact types of number of conductors 60 may be modified, as well as the type of jacks 170,330, based on requirements of any particular use of the electrical connector 10. Further, the arc 220 may span over any suitable range, such as from 15 degrees to just less than 360 degrees. Accordingly, it is not intended that the invention be limited, except as by the appended claims.

What is claimed is:

1. An electrical connector for conducting an electrical signal from a source to a destination, comprising:

a cable having an outer sheath and containing at least one insulated electrical conductor, the cable having a distal end and a proximal end;

a substantially L-shaped plug having a conduit therethrough for conveying the at least one electrical conductor of the cable therethrough, and further including distal and proximal ends each having substantially perpendicular longitudinal axes, the distal end adapted to receive the proximal end of the cable therein and including a substantially flat retaining forward side, the proximal end comprising an annular sleeve fixed to the forward side of the distal end and further including a retaining ring fixed to the sleeve, the retaining ring having a larger diameter than the sleeve, a rotational channel being defined by the sleeve, ring, and forward side of the distal end;

a substantially hollow connector housing comprising a distal end and a proximal end, the distal end including a plug retaining means adapted to rotationally capture the rotational channel of the plug, the proximal end including a jack electrically connected to at least one of the at least one electrical conductor of the cable;

whereby the electrical signal may be conducted through the cable, plug, housing, and jack, the cable and plug being rotationally captured by the housing.

2. The electrical connector of claim 1 wherein the plug retaining means of the connector housing is a collar formed in the distal end of the connector housing and projecting into the rotational channel of the plug.

3. The electrical connector of claim 1 wherein the retaining ring of the plug further includes a stop channel formed along a peripheral edge thereof, the stop channel having two ends, and wherein the connector housing includes a stop pin projecting into the stop channel, such that at each end of the stop channel the stop pin limits the rotation of the plug within the housing.

4. The electrical connector of claim 3 wherein the stop channel is formed along generally a 270 degree arc of the retaining ring, such that the plug is limited to rotation of approximately 270 degrees with respect to the connector housing.

5. The electrical connector of claim 1 wherein the retaining ring includes at least one detent depression, and wherein the connector housing includes at least one detent prong mechanically urged with a spring means against the retaining ring along a rotational path of the at least one detent depression as the plug rotates, whereby when the detent depression and the detent prong become aligned the detent prong is urged into the detent depression to cause a discernable detent along the rotational path of the plug within the connector housing.

6. The electrical connector of claim 5 wherein each detent depression is formed within a proximal side of the retaining ring, and wherein each spring means is a coil spring fixed between the connector housing and a spring ring formed in each detent prong, each detent prong further having a longitudinal axis substantially parallel to the longitudinal axis of the proximal end of the plug.

7. The electrical connector of claim 5 wherein the retaining ring has exactly four detent depressions substantially 90 degrees apart with respect to the longitudinal axis thereof.

8. The electrical connector of claim 1 further including at least one connector screw, each connector screw traversing the connector housing from the distal to the proximal ends thereof, each connector screw rotationally captured within the housing and including a shaft having a thread at least partially therealong at a proximal end thereof and a rotation facilitation means at a distal end thereof.

9. The electrical connector of claim 8 wherein the rotation facilitation means is a manual actuator.

10. The electrical connector of claim 8 wherein the rotation facilitation means is a Philips or regular screw head.

11. The electrical connector of claim 1 wherein the cable includes up to 36 electrical conductors and the electrical signal is a video signal.

12. The electrical connector of claim 1 wherein the jack is a female video jack.

13. The electrical connector of claim 1 wherein the jack is a male video jack.

14. The electrical connector of claim 1 wherein the distal end of the cable terminates in a second jack.

15. The electrical connector of claim 14 wherein the distal end of the plug terminates in the second jack, the cable being completely contained within the second jack, the plug, and the connector housing.

16. The electrical connector of claim 6 wherein the at least one detent prong is exactly two.

* * * * *